US006511710B2

(12) United States Patent
Warnecke

(10) Patent No.: US 6,511,710 B2
(45) Date of Patent: Jan. 28, 2003

(54) METHOD OF INTERNALLY COATING A WEAPON BARREL BY A PLASMA FLAME

(75) Inventor: Christian Warnecke, Unterlüss (DE)

(73) Assignee: Rheinmetall W & M GmbH, Unterluss (DE)

( * ) Notice: Subject to any disclaimer, the term of this patent is extended or adjusted under 35 U.S.C. 154(b) by 0 days.

(21) Appl. No.: 09/559,825

(22) Filed: Apr. 28, 2000

(65) Prior Publication Data

US 2001/0051226 A1 Dec. 13, 2001

(30) Foreign Application Priority Data

Apr. 30, 1999 (DE) ..... 199 19 687

(51) Int. Cl.[7] ..... C23C 4/06; C23C 4/10

(52) U.S. Cl. ..... 427/449; 427/450; 427/455; 427/456; 427/236; 427/239; 42/76.02; 89/14.05; 89/16

(58) Field of Search ..... 427/449, 450, 427/453, 454, 455, 456, 236, 239; 42/76.02; 89/16, 14.05

(56) References Cited

U.S. PATENT DOCUMENTS

| | | | | |
|---|---|---|---|---|
| 2,792,657 A | | 5/1957 | Slowter | |
| 3,503,787 A | * | 3/1970 | Pendse | 117/93.1 |
| 4,097,275 A | * | 6/1978 | Horvath | 75/203 |
| 4,138,512 A | | 2/1979 | Glaski | |
| 4,302,482 A | * | 11/1981 | Heck | 427/239 |
| 4,590,033 A | | 5/1986 | Chapet | |
| 4,641,450 A | * | 2/1987 | Moll et al. | 42/76.02 |
| 4,669,212 A | * | 6/1987 | Jackson et al. | 42/76.02 |
| 5,041,713 A | | 8/1991 | Weidman | |
| 5,581,928 A | * | 12/1996 | Krumm et al. | 42/76.02 |

FOREIGN PATENT DOCUMENTS

| | | |
|---|---|---|
| JP | 6/347196 | * 12/1994 |
| WO | 0 766 502 A1 | 2/1997 |
| WO | WO 98/34440 | 8/1998 |

OTHER PUBLICATIONS

Copy of Specification as originally filed: U.S. Ser. No. 09/559,826, filed Apr. 28, 2000, Inventor: Christian Warnecke, Title: Method of Internally Coating a Weapon Barrel By Means of A Laser Beam.

* cited by examiner

*Primary Examiner*—Katherine A. Bareford
(74) *Attorney, Agent, or Firm*—Marina V. Schneller; Venable, Baetjer, Howard & Civiletti, LLP

(57) ABSTRACT

A method of coating an inner surface of a weapon barrel includes the following steps: introducing a plasma burner into the weapon barrel; producing a plasma flame by the plasma burner; directing the plasma flame against the inner barrel surface to cause impingement thereon; introducing a coating material in powder, wire or ribbon form into the plasma flame for melting the coating material to form a molten liquid and for depositing the molten liquid by the plasma flame on the inner barrel surface; and moving the plasma burner inside the weapon barrel axially thereof and relative thereto while performing the depositing step for obtaining a surface coating on the inner barrel surface.

8 Claims, 2 Drawing Sheets

METHOD OF INTERNALLY COATING A WEAPON BARREL BY A PLASMA FLAME

CROSS REFERENCE TO RELATED APPLICATION

This application claims the priority of German Application No. 199 19 687.7 filed Apr. 30, 1999, which is incorporated herein by reference.

BACKGROUND OF THE INVENTION

The invention relates to a method of coating an inner surface of a weapon barrel with at least one layer for protecting the inner barrel surface against corrosion.

Because of the significantly augmented performance of present-day ammunition, substantial corrosion phenomena appear particularly in weapon barrels made of steel, due to the high gas temperatures and flow velocities occurring when the weapon is fired. Such corrosion results in a worn weapon barrel before it reaches the period when material fatigue sets in. It has been known to provide the weapon barrels with a hard chromium layer to avoid such corrosion. In the conventional processes the hard chromium is deposited electrolytically on the inner surface of the weapon barrel.

It is, among others, a disadvantage of the known processes that the electrolytically deposited hard chromium layers do not adequately resist the effects of performance-enhanced ammunition. As a result, the chromium layer tends to peel and thus significant corrosions appear on the exposed inner surface portions.

SUMMARY OF THE INVENTION

It is an object of the invention to provide an improved method for the internal coating of a weapon barrel by means of which, for avoiding corrosions, coating materials of high melting point may be applied with a high degree of adhesion to the inner barrel surface of the weapon.

This object and others to become apparent as the specification progresses, are accomplished by the invention, according to which, briefly stated, the method of coating an inner surface of a weapon barrel includes the following steps: introducing a plasma burner into the weapon barrel; producing a plasma flame by the plasma burner; directing the plasma flame against the inner barrel surface to cause impingement thereon; introducing a coating material in powder, wire or ribbon form into the plasma flame for melting the coating material to form a molten liquid and for depositing the molten liquid by the plasma flame on the inner barrel surface; and moving the plasma burner inside the weapon barrel axially thereof and relative thereto while performing the depositing step for obtaining a surface coating on the inner barrel surface.

The invention is thus based on the principle to perform the inner coating of the weapon barrel by plasma welding.

By a suitable relative motion between the plasma burner and the weapon barrel a surface coating of the inner surface of the weapon barrel may be obtained. Further, by repeating the coating process it is possible to sequentially provide different layers and to adapt the weapon barrel to the respective requirements.

It is a significant advantage of the method according to the invention that high-melting point substances such as niobium, molybdenum, tantalum, hafnium, vanadium, tungsten, zirconium or alloys thereof may be applied in layer thicknesses up to a few millimeters on the inner surface of the weapon barrel. It is noted in this connection that substances such as molybdenum or tantalum cannot be separated from aqueous electrolytes with the known galvanic processes. Further, with the known processes layer thicknesses of only a few tenths of a millimeter may be produced.

The coating may be performed on the entire inner surface of the weapon barrel or on selective length portions thereof. In either case, care has to be taken to adapt the weapon barrel to the intended thickness of the coating before the coating process, that is, the barrel portion to be coated has to have a diameter which corresponds to the weapon caliber plus twice the thickness of the coating.

For performing a coating of the weapon barrel with high-melting point metal salts, such as carbides or nitrides, it has been found advantageous to introduce into the plasma a suitable gas in addition to the metal, for example, methane for forming carbides or nitrogen for forming nitrides.

DESCRIPTION OF THE PREFERRED EMBODIMENTS

Figure 1:
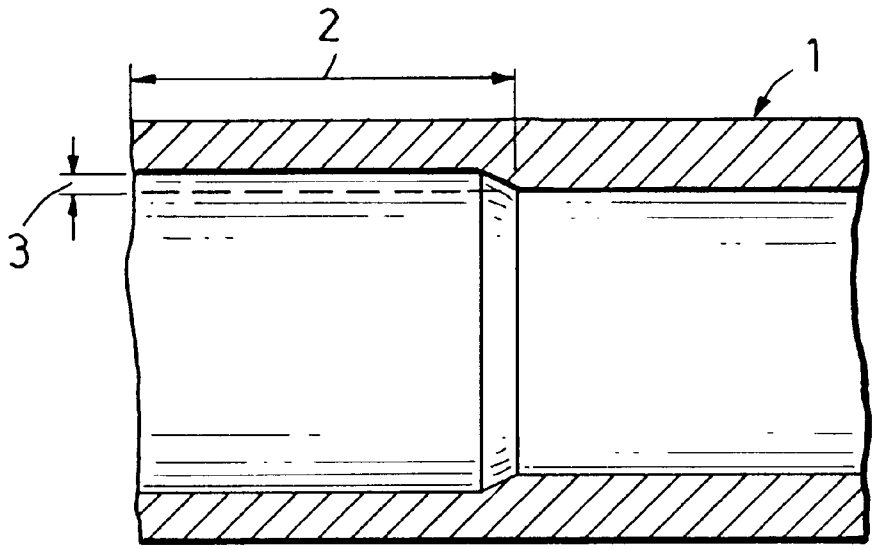
FIG. 1 shows a fragmentary axial sectional portion of a weapon barrel before the coating process.

FIG. 1 shows a weapon barrel 1 whose length portion 2 is to be coated with a refractory metal such as niobium. Along the portion to be coated the weapon barrel has an inner diameter which exceeds the weapon caliber by twice the distance 3.

Figure 2:
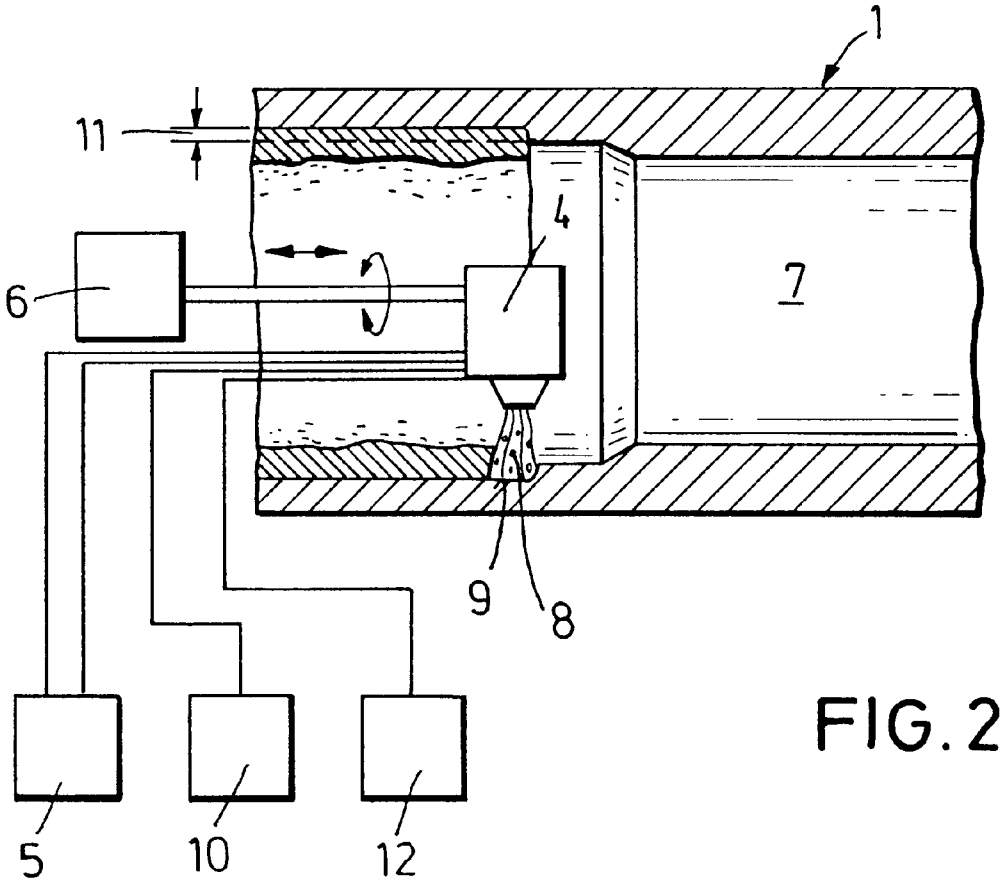
FIG. 2 shows a fragmentary axial sectional view of a weapon barrel during the coating process.

Turning to FIG. 2, for coating the weapon barrel 1 a plasma burner 4 is provided, having a cathode and a water-cooled anode (neither is shown for the sake of clarity). The cathode and the anode are connected with a current source 5 by suitable electric conductors. When a coating of a weapon barrel 1 is to be performed, an electric arc is produced between the cathode and the anode and the plasma burner 4 is introduced into the inner chamber 7 of the weapon barrel 1 by means of an advancing mechanism 6.

Since the weapon barrel is at the potential of the anode, the plasma flame 8 extends to the inner surface 9 of the weapon barrel 1. The layer-forming substance which may be accommodated, for example, as a powder in a container 10, is introduced into the plasma flame 8 and melted thereby. Based on the flow velocity of the expanding plasma gases, the drop-shaped molten, flowing substance particles are thrown against the inner barrel surface 9 to be coated. Since the weapon barrel 1 is likewise melted in a relatively narrow region 11 in the vicinity of its upper surface by the plasma flame 8, an alloy is formed by the barrel material and the coating material. Such a molten bond of the two substances leads to a very high adhesion of the coating material to the inner surface 9 of the weapon barrel 1.

To prevent the molten liquid coating substance from reacting with the surrounding atmosphere (and to thus avoid the formation of oxides, nitrides or carbides) it has been found advantageous to surround the plasma flame 8 and the molten bath by a protective gas coat. For this purpose, a container 12 filled with a protective gas is provided which is connected by means of conduits with the plasma burner 4.

A surface coating of the inner surface 9 of the weapon barrel 1 in the partial region 2 is obtained by helically moving the plasma burner 4 and the weapon barrel 1 relative to one another. For this purpose, for example, the moving device 6 axially advances and simultaneously rotates the plasma burner 4. Or, the plasma burner 4 is displaced solely axially by the device 6, while the weapon barrel 1 is rotated about its longitudinal axis by a non-illustrated drive.

Figure 3:
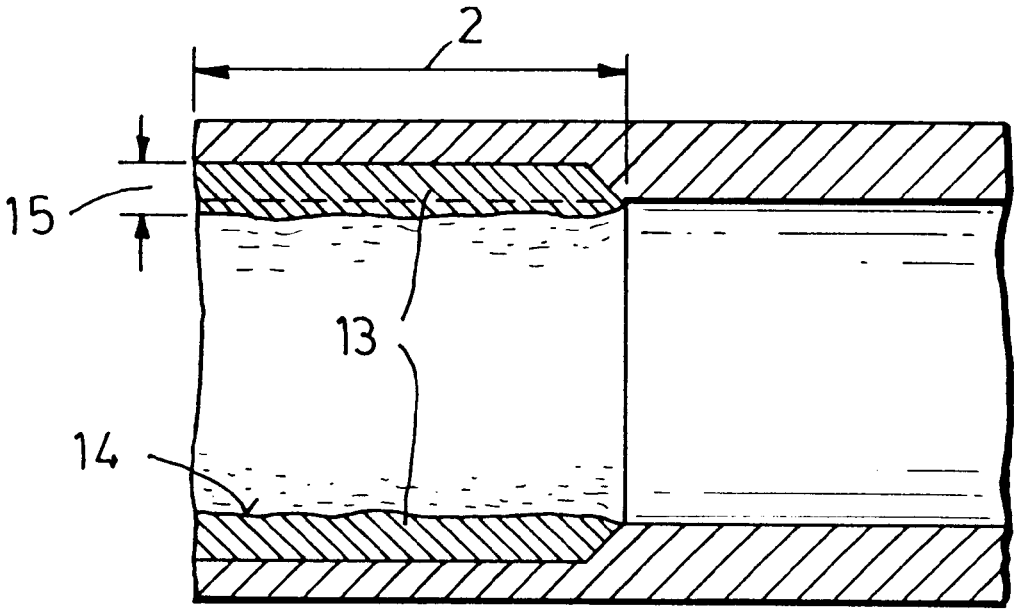
FIG. 3 shows a fragmentary axial sectional view of a weapon barrel after the coating process.
Figure 4:
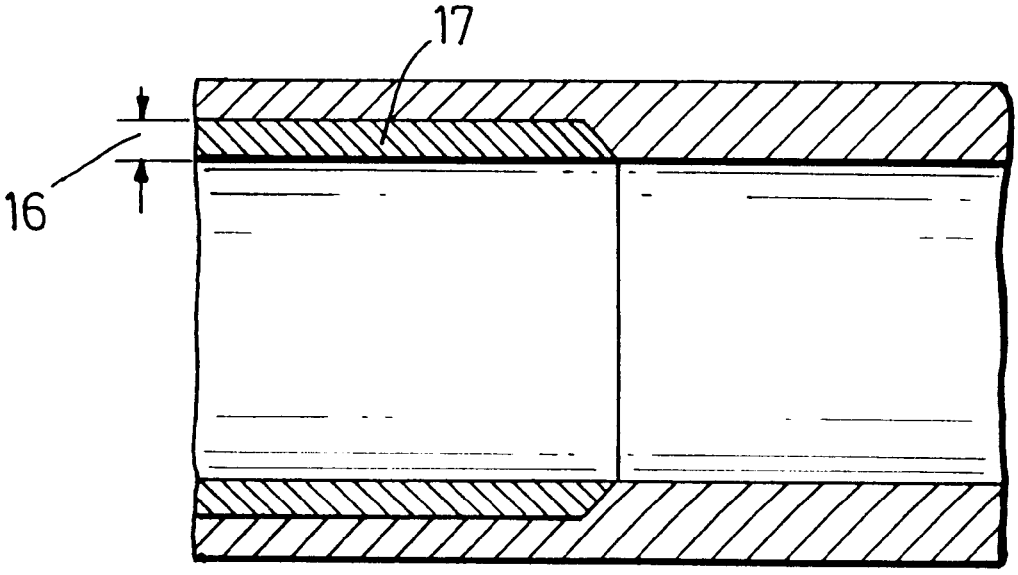
FIG. 4 is a fragmentary sectional axial view of the weapon barrel subsequent to a mechanical treatment performed after the coating process.

After fully applying the layer 13 on the partial length portion 2 of the weapon barrel 1 (FIG. 3), the coated surface is worked by machining, since the layer 13 has a relatively coarse upper surface 14. For this reason, the layer thickness 15 which needs to be originally applied has to be greater than the layer thickness 16 of the layer 17 of the finished weapon barrel, as shown in FIG. 4.

It is to be understood that the invention is not limited to the particular example described above. Thus, for example, for producing the protective gas jacket before the coating process, the entire weapon barrel 1 may be exposed to the protective gas. In the alternative, the protective gas jacket may be dispensed with and the weapon barrel 1 may be evacuated before the coating process.

To improve the strength of adhesion it may be advantageous to sequentially provide on the inner barrel surface several layers of the same or different coating materials.

Further, by using intermediate layers, coating materials may be applied to the substrate (for example, steel) which cannot be welded on directly. Thus, for example, for applying a chromium or molybdenum layer first as intermediate layer a nickel based alloy is applied to the steel substrate. The layer thicknesses of the top and intermediate layers should be between 0.5 and 1.5 mm dependent on the mode of application.

It will be understood that the above description of the present invention is susceptible to various modifications, changes and adaptations, and the same are intended to be comprehended within the meaning and range of equivalents of the appended claims.

What is claimed is:

1. A method of a coating an inner surface of a weapon barrel to protect said weapon barrel inner surface against corrosion comprising the following steps:

(a) introducing a plasma burner into the weapon barrel;

(b) producing a plasma flame by the plasma burner;

(c) directing the plasma flame against the inner barrel surface to cause impingement thereon and to heat material of said weapon barrel inner surface to a temperature at which said material of said weapon barrel inner surface melts;

(d) introducing a coating material into the plasma flame for melting the coating material to form a molten liquid and for depositing the molten liquid by the plasma flame directly on the inner surface, wherein said coating material is in the form of powder, wire or ribbon and wherein said coating material is selected from the group consisting of niobium, molybdenum, tantalum, hafnium, vanadium, tungsten, zirconium and alloys thereof; and (e) moving the plasma burner inside the weapon barrel axially thereof and relative thereto and alloying at least a portion of said coating material at said surface while performing steps (b), (c) and (d) for obtaining a surface coating on the inner barrel surface.

2. The method as defined in claim 1, further comprising the step of applying sequentially several layers of identical coating material on the inner barrel surface.

3. The method as defined in claim 1, further comprising the step of applying sequentially several layers of different coating material on the inner barrel surface.

4. The method as defined in claim 1, wherein said moving step comprises the step of depositing the coating material on the inside barrel surface to a thickness between 0.5 and 1.5 mm.

5. A method of coating an inner surface of a steel weapon barrel to protect said weapon barrel inner surface against corrosion comprising:

(a) introducing a plasma burner into the weapon barrel;

(b) producing a plasma flame by the plasma burner;

(c) directing the plasma flame against the inner barrel surface to cause impingement thereon and to heat material of said weapon barrel inner surface to a temperature at which said material of said weapon barrel inner surface melts;

(d) introducing a coating material comprising nickel into the plasma flame for melting the coating material to form a molten liquid and for depositing the molten liquid by the plasma flame directly on the inner surface to form a nickel-based alloy, wherein said coating material is in the form of powder, wire or ribbon;

(e) moving the plasma burner inside the weapon barrel axially thereof and relative thereto and alloying at least a portion of said coating material at said surface while performing steps (b), (c) and (d) for obtaining a surface coating on the inner barrel surface, and, after (e); and (f) sequentially applying at least a second coating layer by sequentially introducing a second coating material source in the plasma flame, wherein the second coating material source comprises either chromium or molybdenum.

6. The method of claim 5 wherein the second coating layer source comprises chromium.

7. A method of coating an inner surface of a weapon barrel with a metal carbide to protect said weapon barrel inner surface against corrosion comprising:

(a) introducing a plasma burner into the weapon barrel;

(b) producing a plasma flame by the plasma burner;

(c) directing the plasma flame against the inner barrel surface to cause impingement thereon and to heat material of said weapon barrel inner surface to a temperature at which said material of said weapon barrel inner surface melts;

(d) introducing a coating material source and methane into the plasma flame for melting the coating material source to form a molten liquid and for depositing the molten liquid by the plasma flame on the inner surface, wherein said coating material source is in the form of powder, wire or ribbon; and (e) moving the plasma burner inside the weapon barrel axially thereof and relative thereto and alloying at least a portion of coating material at said surface while performing steps (b), (c) and (d) for obtaining a surface coating on the inner barrel surface.

8. A method of coating an inner surface of a weapon barrel with a metal nitride to protect said weapon barrel inner surface against corrosion comprising:

(a) introducing a plasma burner into the weapon barrel;

(b) producing a plasma flame by the plasma burner;

(c) directing the plasma flame against the inner barrel surface to cause impingement thereon and to heat material of said weapon barrel inner surface to a temperature at which said material of said weapon barrel inner surface melts;

(d) introducing a coating material source and nitrogen into the plasma flame for melting the coating material source to form a molten liquid and for depositing the molten liquid by the plasma flame on the inner surface, wherein said coating material is in the form of powder, wire or ribbon; and (e) moving the plasma burner inside the weapon barrel axially thereof and relative thereto and alloying at least a portion of said coating material at said surface while performing steps (b), (c) and (d) for obtaining a surface coating on the inner barrel surface.

* * * * *